US007666348B2

(12) United States Patent
Ishijima et al.

(10) Patent No.: US 7,666,348 B2
(45) Date of Patent: Feb. 23, 2010

(54) PRODUCTION METHOD OF ELECTRODE FOR COLD CATHODE FLUORESCENT LAMP

(75) Inventors: Zenzo Ishijima, Matsudo (JP); Masahiro Okahara, Matsudo (JP); Narutoshi Murasugi, Matsudo (JP)

(73) Assignee: Hitachi Powdered Metals Co., Ltd., Matsudo-shi (JP)

( * ) Notice: Subject to any disclaimer, the term of this patent is extended or adjusted under 35 U.S.C. 154(b) by 272 days.

(21) Appl. No.: 11/429,178

(22) Filed: May 8, 2006

(65) Prior Publication Data

US 2006/0257279 A1 Nov. 16, 2006

(30) Foreign Application Priority Data

May 11, 2005 (JP) ..... 2005-138523

(51) Int. Cl.
*B22F 3/12* (2006.01)

(52) U.S. Cl. ..... 419/37

(58) Field of Classification Search ..... 419/10; 313/311, 618, 346, 620, 621, 632, 574, 310, 313/631, 485; 445/46
See application file for complete search history.

(56) References Cited

U.S. PATENT DOCUMENTS

| | | | | |
|---|---|---|---|---|
| 2,375,252 | A * | 5/1945 | Sayre | 264/119 |
| 2,556,951 | A * | 6/1951 | Weidner | 425/78 |
| 3,721,550 | A * | 3/1973 | Schreiner et al. | 419/27 |
| 4,788,627 | A * | 11/1988 | Ehlert et al. | 361/717 |
| 5,122,326 | A * | 6/1992 | Jackson et al. | 264/102 |
| 6,197,252 | B1 * | 3/2001 | Bishop et al. | 419/36 |
| 6,218,025 | B1 * | 4/2001 | Fromm et al. | 428/544 |
| 6,733,703 | B2 * | 5/2004 | Billiet et al. | 264/40 |
| 6,800,997 | B2 * | 10/2004 | Yamashita et al. | |
| 6,943,499 | B2 * | 9/2005 | Yamashita et al. | |
| 7,232,473 | B2 * | 6/2007 | Elliott | 75/245 |
| 2004/0168907 | A1 * | 9/2004 | Sato | 204/192.1 |
| 2004/0216589 | A1 * | 11/2004 | Amick | 86/54 |
| 2007/0169586 | A1 * | 7/2007 | Yang et al. | 75/232 |

FOREIGN PATENT DOCUMENTS

| | | | |
|---|---|---|---|
| JP | A-02-141502 | * | 5/1990 |
| JP | A-02-221145 | * | 9/1990 |
| JP | A-08-073902 | * | 3/1996 |
| JP | A-10-144255 | * | 5/1998 |
| JP | A-2002-289138 | * | 10/2002 |

* cited by examiner

*Primary Examiner*—Roy King
*Assistant Examiner*—Yoshitoshi Takeuchi
(74) *Attorney, Agent, or Firm*—Oliff & Berridge, PLC

(57) ABSTRACT

A production method includes: preparing a metal powder composed of one of Mo and W, and a binder composed of a thermoplastic resin and a wax; mixing the metal powder and 40 to 60 volume % of the binder with respect to the metal powder into a mixed powder; and heating and kneading the mixed powder into a raw material. The production method further includes: supplying a predetermined of the raw material in a hole of a die; and compacting the raw material into a cup-shaped green compact by pressing the raw material by a punch, the cup-shaped green compact having a cylindrical portion, a bottom formed at one end portion thereof, and an opening formed at another end portion thereof. The production method further includes: ejecting the cup-shaped green compact from the hole of the die; removing the binder from the ejected cup-shaped green compact by heating; and sintering the cup-shaped green compact by heating the green compact and diffusion-bonding particles of the green compact.

21 Claims, 2 Drawing Sheets

PRODUCTION METHOD OF ELECTRODE FOR COLD CATHODE FLUORESCENT LAMP

BACKGROUND OF THE INVENTION

1. Field of the Invention

The present invention relates to cold cathode fluorescent lamps used for, for example, illuminating light sources and backlights of liquid crystal displays for monitors of personal computers, liquid crystal televisions, and car navigations, etc. In particular, the present invention relates to a production method for an electrode which is advantageously applied to the above cold cathode fluorescent lamps.

2. Description of the Related Art

As shown in FIG. 1, a cold cathode fluorescent lamp has a structure in which electrodes 3 are disposed at both ends of a glass tube 1 and are electrically connected to outer devices via terminals 2. A phosphor 4 is coated on an inner surface of the glass tube 1, and a filler gas 5 composed of a rare gas and a small amount of mercury (Hg) is filled in the glass tube 1. In the cold cathode fluorescent lamp, high electric field is applied to the electrodes 3 disposed at both ends of the glass tube 1, and a glow discharge is generated in a low-pressure mercury vapor. As a result, ultraviolet rays are generated by mercury excited by the glow discharge, and the phosphor 4 filled in the glass tube 1 is excited by the ultraviolet rays, thereby emitting light. Cup-shaped electrode which can provide hollow cathode effect have been used as the electrode 3 in recent years. In this case, the terminals 2 are bonded to bottoms of the cup-shaped electrodes 3 by brazing or the like, and the terminals 2 and the electrodes 3 are integrally formed.

The cold cathode fluorescent lamp having the above structure has been applied to backlights of liquid crystal displays in recent years. Recently, the above cold cathode fluorescent lamp has been applied to liquid crystal televisions and liquid crystal displays for car navigations, and has been widely used. The number of the cold cathode fluorescent lamp of the display having 15 inches or less is usually one for a product. However, required luminance cannot be obtained when the cold cathode fluorescent lamp is applied to large monitors, televisions, or the like, so that plural cold cathode fluorescent lamps are used. Therefore, demand to the cold cathode fluorescent lamp has increased rapidly.

While demand to cold cathode fluorescent lamps is increasing, the following items (1) to (5) are required in cold cathode fluorescent lamps and electrodes used therefore to improve performance of liquid crystal displays.

(1) From requirements of making products to be thin and light, cold cathode fluorescent lamps are required to have a small diameter, and electrodes are required to be further small and superior in forming in accordance with the requirement in the cold cathode fluorescent lamps.

(2) In liquid crystal displays, the improvement in a contrast ratio thereof is required, and high luminance of cold cathode fluorescent lamps is required. Luminance of the cold cathode fluorescent lamps substantially increases in proportion to inner diameters thereof. However, since the cold cathode fluorescent lamps have been improved to be small, the electrodes are required to be composed of a material having good electric discharge characteristics, that is, a material having low cathode drop voltage.

(3) In accordance with requirements in lower power consumption of products, lower power consumption of cold cathode fluorescent lamps is required. In the requirement in lower power consumption of cold cathode fluorescent lamps, the electrodes are required to be composed of a material having lower cathode drop voltage so as to emit light in an intensity level higher than that of the conventional technique.

(4) Since service life of a cold cathode fluorescent lamp is essential factor of service life of a product, service life of a cold cathode fluorescent lamp is required to be longer. Therefore, electrodes are required to be composed of a material which is difficult to be sputtered when amount of electric discharge increases.

(5) Since the market competition in price among providers of liquid crystal displays is intensified, high price products cannot be sold even if the products satisfy the above items (1) to (4). Therefore, the production cost of the products is required to be low.

In conventional techniques, since nickel has low cathode drop voltage and is easily machined, Ni has been used as an electrode material for cold cathode fluorescent lamps. However, in nickel electrodes, if amount of electric current is increased to increase amount of electric discharge and thereby obtain a high luminance of a cold cathode fluorescent lamp, the temperature of the lamp rises, and the mercury pressure is too high, so that light flux is saturated. The increase in applying voltage causes increase in consumption power. Therefore, materials having lower cathode drop voltage are required to apply to electrodes instead of nickel.

As disclosed in Japanese Unexamined Patent Application Publication No. H10-144255 and Japanese Unexamined Patent Application Publication No. 2002-289138, a material layer having a work function lower than that of nickel is provided on an inner surface of a cup-shaped electrode for cold cathode fluorescent lamps, so that amount of electric discharge is increased. However, the manufacturing process of the electrode requires a treatment to coat the material layer having a low work function. Since the substrate of the electrode is composed of nickel, wear degree of the electrode cannot be improved, and all of the above items (1) to (5) cannot be satisfied.

In order to solve the above problems, a metal having a low work function and a high melting point and being difficult to sputter has been researched, and molybdenum is started to apply to electrode materials. Tungsten having much higher melting point than molybdenum has been researched to apply to electrode materials.

An electrode composed of molybdenum for cold cathode fluorescent lamps is formed by punching and deep drawing a rolled plate into a cup-shape. Since molybdenum has a melting point higher than nickel and electric discharge characteristics better than nickel, the molybdenum electrode satisfies the above items (1) to (4). A molybdenum electrode having an outer diameter of about 1.5 to 3.0 mm and a thickness of about 0.1 to 0.3 mm has been produced. However, rolled plates of molybdenum readily have anisotropic and insufficient ductility, thereby being difficult to be subjected to plastic working. In addition, yield efficiency of the molybdenum plate is not good, whereby production cost of the electrode is high, and the above item (5) is not satisfied. Furthermore, the thickness ratio of a cylindrical portion and a bottom portion of the molybdenum electrode is usually about 1:2 by punching and deep drawing, whereby option of design for electrodes is restricted.

Regarding application of tungsten to an electrode for cold cathode fluorescent lamps, since tungsten is hard and insufficient in ductility, tungsten cannot be subjected to deep drawing, whereby the tungsten electrode has not been on mass production.

SUMMARY OF THE INVENTION

An object of the present invention is to provide a production method which can produce a cup-shaped electrode at low cost, the cup-shaped electrode composed of one of molybdenum and tungsten having a high melting points, which is easily formed and has an outer diameter of about 3.0 mm or less, and superior electric discharge characteristics.

According to one aspect of the present invention, the invention provides a production method for an electrode for a cold cathode fluorescent lamp. The production method includes: preparing a metal powder composed of one of Mo and W, and a binder composed of a thermoplastic resin and a wax; mixing the metal powder and 40 to 60 volume % of the binder with respect to the metal powder into a mixed powder; and heating and kneading the mixed powder into a raw material. The production method further includes: supplying a predetermined of the raw material in a hole of a die; and compacting the raw material into a cup-shaped green compact by pressing the raw material by a punch, the cup-shaped green compact having a cylindrical portion, a bottom formed at one end portion thereof, and an opening formed at another end portion thereof The production method further includes: ejecting the cup-shaped green compact from the hole of the die; removing the binder from the ejected cup-shaped green compact by heating; and sintering the cup-shaped green compact by heating the green compact and diffusion-bonding particles of the green compact.

According to a preferred embodiment, the punch has a first punch, a second punch, and a third punch, the first punch used for forming the bottom of the cup-shaped green compact, the second punch used for forming an inner diameter portion of the cup-shaped green compact, the third punch used for pressing an edge surface of the opening, and the first punch is fixed to the die, the second punch is pressed toward the raw material, and a backpressure is applied to the raw material by the third punch, so that the compacting is performed.

In the aspect of the present invention, one of molybdenum and tungsten which have good electric discharge characteristics is used for an electrode material. The cup-shaped electrode having a small thickness of 0.1 to 0.3 mm can be produced at low cost. The electrode can have a small size, the electric discharge characteristics for high luminance and low power consumption can be improved, and service life of product can be improved.

In the electrode produced by the aspect of the present invention, one of molybdenum and tungsten which have good electric discharge characteristics is used for an electrode material, and good hollow cathode effects can be obtained by an approximately or almost spherical shape formed on the electrode surface. Therefore, the electric discharge characteristics for increasing the luminance and reducing the power consumption can be improved, and service life of product can be improved.

DETAILED DESCRIPTION FOR THE INVENTION

Figure 1:
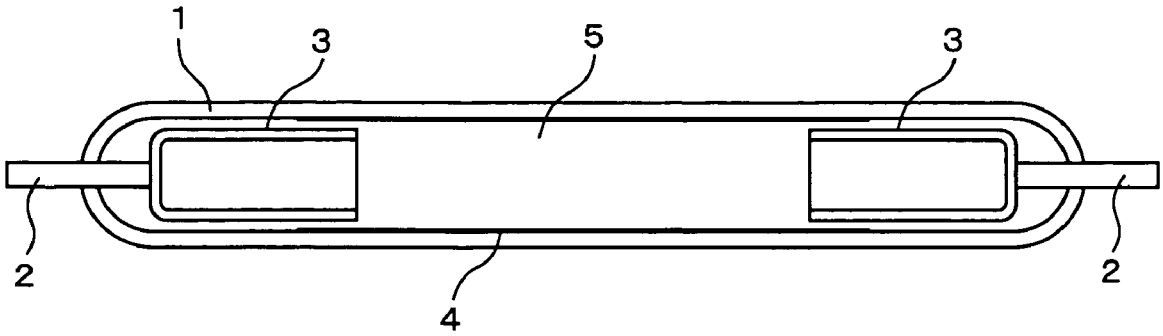
FIG. 1 is a cross sectional view showing a structure of a cold cathode fluorescent lamp.

Since the cost reduction is difficult in forming a molybdenum electrode from a molybdenum plate material by deep drawing and it is difficult technique to form a tungsten electrode, the inventors researched on powder metallurgy methods which can be used for an electrode of Molybdenum and an electrode of tungsten. The powder metallurgy methods are broadly classified into a die pressing method and an injection molding method. In the die pressing method, a raw powder is filled in a hole of a die, and the raw powder is compacted into a green compact by pressing by a punch. The green compact is sintered into a sintered compact. In the injection molding method, a raw powder and a large amount of binder are mixed kneaded into a raw material having flowability, the raw material is injected and filled into a gap of a die by pressing to obtain the green compact. The binder is removed from the green compact by heating, and the green compact is sintered.

In the die pressing method, due to flowability of the raw powder and the lubricity between the raw material and the die, about 1 mass % or less of a lubricant is often mixed into the raw powder. Since amount of the lubricant is small, the lubricant can be easily removed from the raw powder by volatilizing in an initial step of the sintering process. Therefore, a lubricant removal process can be short. In the die pressing method, filling of a raw powder in a die is performed such that a raw powder is dropped from a powder feeder apparatus into a space which is formed by a die and a lower punch, etc. The feeder apparatus is called as powder box. In this method, unevenness in the filling of the raw powder is inevitably generated. In a small product such as the required electrode, the above unevenness is unallowable. The required thickness of the electrode is small as described above. When the raw powder is filled in a small gap formed in order to obtain the above thickness, the particle size of the raw powder should be small. In this case, the flowability of the raw powder is decreased, and the fillability of the raw powder is decreased, so that reliable supply of the raw powder cannot be performed.

In the injection molding method, a form of a green compact having an under cut or the like which cannot be obtained by the die pressing method can be obtained. However, since the raw powder is mixed with 30 to 70 volume % of a binder composed of a thermoplastic resin or the like, so that the flowability of the raw material can be ensured. Therefore, the green compact includes a large amount of binder, so that a binder removal process for removing the binder takes a long time. In order to obtain a small form of the green compact having the required outer diameter of about 3.0 mm or less and the thickness of about 0.1 to 0.3 mm, a cavity for forming the green compact is too small, and it may be difficult to uniformly fill a metal powder in the cavity, That is, since the gap of the die in which the raw material is filled is small, when the raw material is filled in the gap, the filling of the raw material should be performed at a high pressure. However, a high pressure apparatus for the injection molding method is not practical. It should be noted that the limit of the thickness range enabling the injection molding may be 0.5 mm.

In order to solve the above problems, a forming method having the advantages of the die pressing method and the injection molding method has been proposed as disclosed in Japanese Unexamined Patent Application Publication No. H2-141502, Japanese Unexamined Patent Application Publication No. H2-221145, and Japanese Unexamined Patent Application Publication No. H8-73902. That is, in the above method, amount of a binder in a raw material is more than that in the typical die pressing method, and the raw material is compacted by a die pressing method. In Japanese Unexamined Patent Application Publication No. H2-141502, a mixed powder of a metal powder, an alloy powder, a graphite powder, and a nonmetal powder is mixed with 10 to 45 volume %. of an organic binder with respect to the mixed powder. The mixed powder is kneaded and granulated so as to have a particle size of 0.1 to 1 mm. The granulated powder is filled in a die having a form corresponding to that of a production, and is compacted into a green compact. The green compact is degreased and sintered.

In Japanese Unexamined Patent Application Publication No. H2-221145, a mixture including a thermoplastic polymer as a main component, 15 to 50 volume % of a binder, and the balance of an inorganic powder is kneaded, grinded, and compacted into a green compact at temperatures at which the binder can flow therein. The binder is removed from the green compact by heating in the air or an inert atmosphere, and is sintered.

In Japanese Unexamined Patent Application Publication No. H8-73902, a cemented carbide powder is mixed and kneaded with 30 to 60 volume % of an organic binder with respect to the cemented carbide powder. The mixed and kneaded mixture is filled in a die, and is pressed by a press. Alternatively, a ceramics powder is mixed and kneaded with 10 to 20 volume % of an organic binder with respect to the ceramics powder. The mixed and kneaded mixture is filled in a die, and is pressed by a press.

In the present invention, the inventors focused on a method in which a large amount of a binder or the like in a raw material is more than that in the typical die pressing method, and the raw material is compacted into a green compact by a die pressing method. Molybdenum or tungsten is used as the material, and the die pressing method is improved and controlled in order to obtain a desired cold cathode fluorescent lamp as described below.

Since the binder which is added to a metal powder composed of tungsten or molybdenum and is kneaded must flow in a small gap of a die as described above, amount of the binder should be 40 volume % or more. If amount of the binder is less than 40 volume %, flowability of the material is insufficient, and the metal powder cannot be uniformly supplied in the gap of the die. On the other hand, if amount of the binder is more than 60 volume %, subsequent binder removal process takes a long time, so that a production cost is increased. Since the green compact includes the binder too much, the metal powder cannot be uniformly filled in the gap of the die, the form stability is damaged in the binder removal process and a sintering process, and the green compact is thereby easily collapsed. Therefore, the amount of the binder with respect to the metal powder should be 40 to 60 volume %.

The binder may be composed of thermoplastic resin and wax. The thermoplastic resin is used for providing the plasticity to the raw material. The thermoplastic resin may be selected from the group consisting of polystyrene, polyethylene, polypropylene, polyacetal, and polyethylene vinylacetate, etc. The wax is added for preventing metal contact between the material (in particular, the metal powder) and the die (which includes a dice and a punch), and for obtaining uniform flowability of the metal powder in a compacting process. In addition, the wax is added for reducing friction between the green compact and the die in a ejecting process and easily ejecting the green compact ejected from the die. The wax may be selected from the group consisting of a paraffin wax, an urethane wax, and a carnauba wax, etc. The thermoplastic resin and the wax having the above actions are in the ratio of from 20:80 to 60:40, so that a desired binder is obtained.

The molybdenum powder or the tungsten powder which is used as the material preferably has a particle of 10 μm or less. If the particle size is more than 10 μm, it is difficult to uniformly supply the metal powder in a small gap of a die, the gap corresponding to a thickness of the desired electrode.

Regarding the form of the powder, the powder preferably has an approximately or almost spherical shape. The molybdenum powder preferably has a tap density of 3.0 $Mg/m^3$ or more. The tungsten powder preferably has a tap density of 5.6 $Mg/m^3$ or more. In general, the molybdenum powder is produced by reducing a Mo oxide, and some particles of the molybdenum powder are bonded with each other. If the metal powder has large recesses and protrusions formed in the above manner, the metal powder cannot be uniformly supplied and densified in the die. Therefore, after the Mo powder is reduced, the particles thereof should be subjected to a grinding process. In general, a corrugated condition of a powder is shown by a tap density. When the number of corrugated portions is small, the desired supplying condition of the powder in a die can be realized, and the tap density becomes high. On the other hand, when the number of corrugated portions is large, bridging easily occurs in the powder, and the tap density becomes low. From the above viewpoint of the tap density, the molybdenum powder preferably has a tap density of 3.0 $Mg/m^3$ or more. The tungsten powder preferably has a tap density of 5.6 $Mg/m^3$ or more. If each powder has a tap density lower than the above value, the powder cannot be uniformly supplied and densified in a die, and thickness and form of each electrode obtained after a binder removal process and a sintering process are uneven.

Figure 3A:
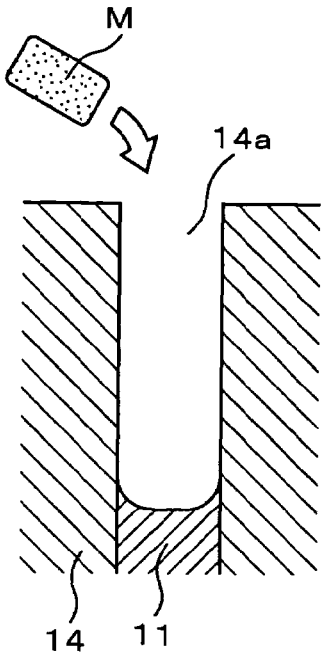
FIG. 3 is a cross sectional view showing a supplying process, a compacting process, and an ejecting process in a production method for a cold cathode fluorescent lamp of the present invention.
Figure 3B:
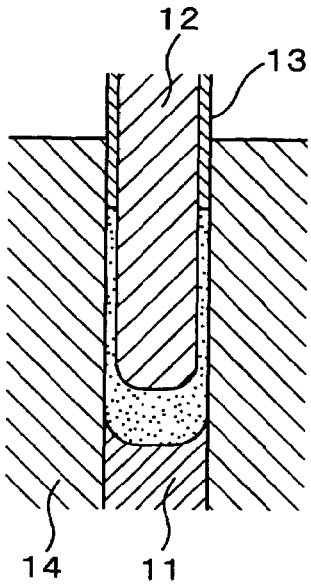
Figure 3C:
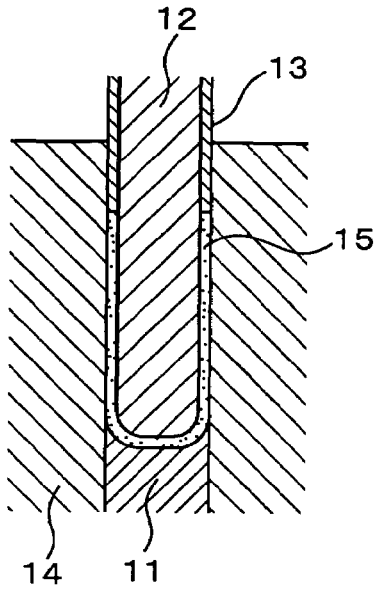
Figure 3D:
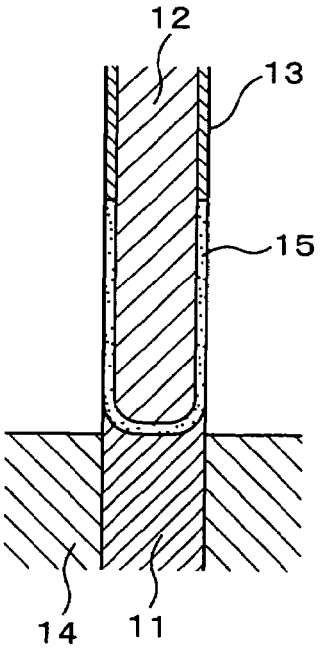
Figure 3E:
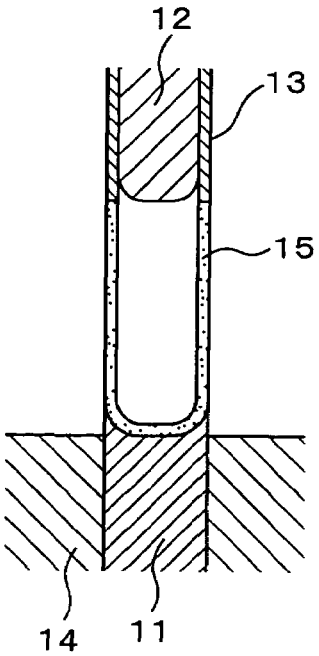
Figure 3F:
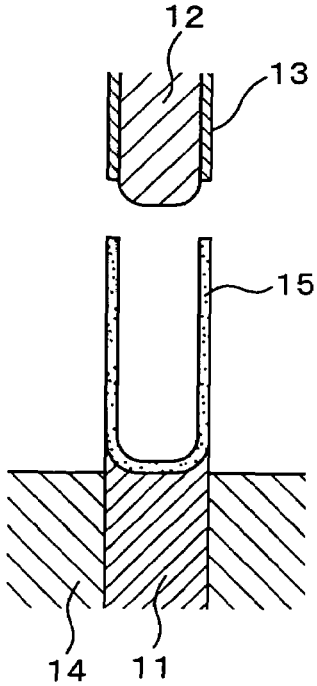

The metal powder composed of above molybdenum powder or the above tungsten powder is mixed and kneaded with the above binder, so that a raw material M is obtained. As shown in FIG. 3A, a predetermined amount of the raw material M is supplied in a hole 14*a* of a die. Next, as shown in FIGS. 3B and 3C, a first punch 11, a second punch 12, and a third punch 13 are prepared for compacting the raw material M, which is supplied in the small gap of the die, into a cup-shaped green compact. The first punch 11 is used for forming the bottom of the cup-shaped green compact. The second punch 12 is used for forming an inner diameter portion of the cup-shaped green compact. The third punch 13 is used for pressing an opening edge surface of the cup-shaped green compact. The first punch 11 is fixed to a die 14, the second punch 12 is pressed toward the raw material M, and a backpressure is applied to the raw material M by the third punch 13, so that the raw material M is compacted into a cup-shaped green compact 15. Next, as shown in FIG. 3D, the first punch 11, the second punch 12, the third punch 13 are ejected together with the cup-shaped green compact 15 upward from the die 14. As shown in FIG. 3E, the second punch 12 is ejected upward from the cup-shaped green compact 15. As shown in FIG. 3F, the second punch 12 and the third punch 13 are lifted, and are separated from the cup-shaped green compact 15. As a result, the cup-shaped green compact 15 is ejected from the die 14. Instead of compacting by backward extrusion as shown in FIGS. 3B and 3C, forward extrusion may be performed by lifting the first punch 11. In both cases, when a backpressure is applied to the raw material M by using the third punch 13, and the raw material M is compacted, the raw material M can be compacted so as to have edge portions having uniform height, and cup-shaped green compact 15 can have a uniform density of the raw material. Therefore, it is preferable that a backpressure be applied to the raw material M by using the third punch 13 and the raw material M be compacted.

In the above compacting process, since the raw material should flow and be supplied in a small gap of the die, the raw material should be heated to a temperature which is a softening point of the thermoplastic resin, which is included in the binder, or higher before the pressure is applied thereto. If the raw material is not heated or the raw material is heated to a temperature which is lower than the softening point of the thermoplastic resin, the flowability of the raw material is insufficient, so that the raw material cannot be uniformly supplied and densified in the small gap of the die. The raw material is more preferably heated to a temperature which is a melting point of the thermoplastic resin or higher, the raw material having the highest flowability at the melting point. A heater or the like may be provided in the die, and the heating may be performed after the raw material is filed in the die, or the raw material may be heated beforehand and may be supplied to the die.

In order to use the raw material in a typical die pressing method, the raw material which is a granulated powder having a predetermined particle size may be supplied to a die by a supplying method using a powder feeder apparatus such as a feeder box. However, since a hole of the die is small for compacting the raw material of a desired electrode for cold cathode fluorescent lamps, it is difficult to uniformly supply and densify the granulated powder when the granulated powder has a particle size appropriate to the powder feeder apparatus used in a typical die pressing method. On the other hand, if the particle size of the granulated powder is small, the flowability of the raw material is decreased, so that it is difficult to control the particle size of the granulated powder to be desired. Therefore, as shown in FIG. 3A, it is preferable that the amount of the raw powder corresponding to that of the raw powder supplied in the die may be prepared as one pellet having a size fitted in the gap of the die, and the raw material as the pellet is supplied to the die. In this case, when the raw material is heated beforehand, the supply of the raw material is easily performed, so that the supply of the raw material as the pellet is preferable.

After the raw material is softened, as shown in FIGS. 3B and 3C, the raw material is compacted into the cup-shaped green compact by pressing by the punches in a vertical direction. If the binder included in the cup-shaped green compact maintained to be softened in the ejecting process for ejecting the cup-shaped green compact from the die as shown in FIGS. 3D to 3F, the form of the cup-shaped green compact cannot be maintained, thereby being broken in the ejection process or after the ejection process. Therefore, the ejection process is preferably performed after the cup-shaped green compact is cooled to a temperature which is the softening point of the thermoplastic resin or lower, the thermoplastic resin included in the binder. Thus, the cup-shaped green compact is hardened, the form thereof is maintained during the ejection process or after the ejection process, and the cup-shaped green compact is easily handled. If the cup-shaped green compact is cooled to a temperature which is lower than the softening point of the wax included in the binder, the effects of the wax is decreased, the pressure required in the ejection process is larger, and the form of the cup-shaped green compact is easily broken by the pressure. Therefore, the ejection process is preferably performed at a temperature which is the softening point of the wax or higher. Even if the temperature in the ejection process is the softening point of the wax or higher, the binder easily flows when the temperature in the ejection process is higher the melting point of the wax. Therefore, the ejection process is preferably performed at a temperature which is the melting point of the wax or lower and which is the softening point of the wax or higher.

A heating device such as a heater and a cooling device such as a cooling medium supply tube are provided, and the temperature of the raw material can thereby be easily controlled. As a result, as described above, in the compaction process, the raw material can be heated at a temperature which is the softening point of the thermoplastic resin or higher, and in the ejection process, the raw material can be cooled at a temperature which is the melting point of the wax or lower and which is the softening point of the wax or higher. In this case, a heating device can be provided to a supply device of the raw material. In the above constructed apparatus, it is the most preferable that the die may be heated at a temperature which is the softening point of the thermoplastic resin or higher by the heating device provided to the die beforehand, and the raw material may be heated at a temperature which is the melting point of the thermoplastic resin or higher. It is the most preferable that the raw material may be supplied to the die, the raw material may be subjected to the compacting process. It is the most preferable that the raw material and the die may be cooled to a temperature which is the melting point of the wax or lower and which is the softening point of the wax or higher. It is the most preferable that the green compact may be ejected from the die after that.

Since the cup-shaped green compact obtained in the above manner includes 40 to 60 volume % of the binder, a binder removal process is performed such that the cup-shaped green compact is heated at a decomposition temperature of the binder, so that the binder is removed from the cup-shaped green compact. When the temperature of the green compact rises fast at about the decomposition temperatures of the thermoplastic resin and the wax included in the binder, the thermoplastic resin and the wax rapidly vaporizes and expands, and the form of the cup-shaped green compact is broken. Therefore, the temperature of the green compact should be controlled so as to rise slowly at about the decomposition temperatures of the thermoplastic resin and the wax. From the above viewpoint, the binder removal process preferably includes a first step and a second step as two constant temperature steps. In the first step, the temperature is maintained to be about a sublimation temperature of the wax, so that the wax is removed. In the second step, the temperature is maintained at a decomposition temperature of the thermoplastic resin, so that the thermoplastic resin is removed. In order to generate gases gradually due to the thermal decomposition of the wax and the thermoplastic resin, plural wax and plural thermoplastic resin which are different from each other in decomposition temperature are preferably mixed and used.

In the binder removal process, when all the binder components are removed from the cup-shaped green compact, for example, a corner portion of the metal powder thereof may be broken down since bonding of each particle of the metal powder does not start. Therefore, a very small amount of the binder components should remain in the cup-shaped green compact. The residual binder components remain in the sintered compact as described below, and C included in the residual binder components is an included component. Thus, the amount of the residual binder can be identified by measuring the amount of C. When the sintered compact includes less than 0.01 mass % of C, amount of the residual binder components is small, and the metal powder is lost. Therefore, the sintered compact should include 0.01 mass % or more of C. On the other hand, the upper limit of amount of C in the sintered compact should be 0.5 mass %. Amount of C can be controlled by controlling each constant temperature time of the above two constant temperature steps, and necessary C amount can be obtained when each constant temperature time is 30 to 180 minutes.

In the cup-shaped green compact after the above binder removal process, particles of the metal powder have not been diffused to each other, and are not metallically bonded with each other, so that the cup-shaped green compact is very brittle. Therefore, the cup-shaped green compact is sintered, so that diffusion-bonding of the particles of the metal powder is performed. The sintering temperature is preferable to be 1500° C. or more when the Mo powder is used as the metal powder. The sintering temperature is preferable to be 1700° C. or more when the W powder is used as the metal powder. In the sintering process, since the metal powder is composed of small particles and has an approximately or almost spherical shape as described above, the contact area between the particles of the metal powder is large, so that the metal powder is easily accelerated to density by the sintering process, and the sintered compact is densified to have a density ratio of 80% or more when the sintering temperature is the above temperature. However, when the sintering temperature is lower than the above lower limit of the sintering temperature, densification of the sintered compact by the sintering is not accelerated, so that only the sintered compact having a low density and a low strength is obtained. On the other hand, when the sintering temperature of the Mo powder exceeds 2200° C. and the sintering temperature of the W powder exceeds 2400° C., the sintered compacts have a density ratio of more than 96%, the porosity thereof is decreased, and closed pores which do not communicate each other are increased, so that the hollow cathode effect becomes small. In addition, a furnace used in the sintering process is greatly damaged. Therefore, the upper limits of temperatures of the Mo powder and the W powder are preferable set at the above temperatures. When the sintering atmosphere includes oxygen or carbon, the surface of the metal powder is oxidized or is carbonized, so that it is difficult to accelerate the sintering of the metal powder. When the sintering atmosphere includes hydrogen, the Mo powder absorbs hydrogen so as to expand. Therefore, the sintering atmosphere should be one of an inert atmosphere and a vacuum atmosphere (pressure reduction atmosphere) which do not include the above gases. When the pressure reduction atmosphere has a pressure of 1 MPa or more, the pressure reduction atmosphere should include an inert gas as a carrier gas in order to avoid the above problems.

In the above sintering process, the small amount of the residual binder components should remain until the diffusion of the metal powder starts and neck portions are formed. However, when the sintered compact is accelerated to density after the neck portions are formed, these binder components are blocked in the pores and thereby cannot be removed from the sintered compact. Carbon (C) generated by decomposing the binder components in the sintering process is bonded with metal (molybdenum or tungsten), so that a metal carbide (molybdenum carbide or tungsten carbide) is formed. However, each metal carbide is hard and is difficult to be accelerated to densify by the sintering, the sintered compact is brittle and is easily broken. From this viewpoint, the sintered compact should include 0.5 mass % of C or less.

As described above, the cup-shaped sintered compact obtained by the material adjusting process, the supplying process, the compacting process, the ejecting process, the binder removal process, and the sintering process is composed of one of Mo and W which have a low work function and a high melting point. The raw material has pores and an approximately or almost spherical surface which are originated from that the raw material is a metal powder, and the surface area thereof is larger than that of an electrode formed by punching and deep-drawing a rolled plate. As a result, the hollow cathode effect is large. In the above production method, a gap can be appropriately provided and can be controlled between the die and the second punch. The thicknesses of the cylindrical portion and the bottom of the cup-shaped sintered compact can be controlled by controlling the distance between the first punch and the second punch in the compacting process. The freedom of the design of the cup-shaped sintered compact is large. Therefore, the cup-shaped sintered compact is preferably used for an electrode for cold cathode fluorescent lamps. If the density ratio of the cup-shaped sintered compact is more than 96%, the pores remaining in the cup-shaped sintered compact are insufficient, and closed pores increase. Therefore, the hollow cathode effect is small, and the cup-shaped sintered compact is similar to an electrode formed by punching and deep-drawing a rolled plate. On the other hand, if the density ratio of the cup-shaped sintered compact is less than 80%, the pores increase, and electric discharge occurs inside the pores. Therefore, the amount of electric discharge which does not contribute to emitting light is increased. Although sputtering occurs by the electric discharge in the pores, in the electrode having a low density, the neck portions between the particles of the metal powder have small widths, and are easily lost by the sputtering, so that service life of the electrode is decreased. A mercury vapor does not enter to the pores, and rare gas electric discharge occurs, so that wear of the electrode increases. Therefore, the density ratio of the cup-shaped sintered compact as the electrode for cold cathode fluorescent lamps is preferable 80 to 96%.

Although the thicknesses of the cylindrical portion and the bottom of the electrode for cold cathode fluorescent lamps can be freely designed as described above, if the thicknesses of the cylindrical portion and the bottom are less than 0.1 mm, it is difficult to maintain the form of the green compact, and the form may be broken in the ejecting process or after the ejecting process. On the other hand, if the thickness of the cylindrical portion is large, the inner diameter thereof is small. When the total length is constant and the thickness of the bottom is large, the height of inner periphery is small, and the area of the inner peripheral surface is decreased, so that the amount of electric discharge is decreased. Therefore, in order to maintain good electric discharge characteristics, it is preferable that the thickness of the cylindrical portion be 0.2 mm or less, and thickness of the bottom be 0.4 mm or less. The thicknesses of the cylindrical portion and the bottom can be appropriately selected within the above ranges. For example, the cylindrical portion and the bottom can have the same thickness, so that the amount of electric discharge can be large. In the electrode for cold cathode fluorescent lamps, a terminal is adhered to the bottom of the electrode by brazing. In this case, when the thickness of the bottom is small, a brazing filler material is melted and enters the inner surface via the pores in the brazing, so that the electric discharge characteristics are deteriorated. In order to solve the above problems, the thickness of the bottom is 2 to 4 times as large as the thickness of the cylindrical portion, so that the entering of the brazing filler material to the inner peripheral surface can be prevented.

In the production method using the molybdenum powder or the tungsten powder as the metal powder is described above, since the melting point of molybdenum or tungsten are high, the sintering temperature is set within the temperature range higher than those of typical powder metallurgy techniques. Although nickel has a low cathode drop voltage and is available to an electrode material, nickel has a low melting point as described above. However, when a predetermined amount of nickel is included in the above electrode for cold cathode fluorescent lamps, service life of the electrode is not decreased greatly, and the sintering temperature can be lowered. Therefore, a predetermined amount of nickel is preferably included in the electrode.

It is easy and simple to add a nickel powder to the molybdenum powder or the tungsten powder to contain nickel. That is, since nickel added as a nickel powder has a melting point lower than molybdenum or tungsten, in the sintering process, the nickel powder is melted, wets, and activates the surface of the molybdenum powder or the tungsten powder, so that the neck portions between the particles of the powder are promoted to form and grow. The sintering temperature is low as the amount of the added nickel powder is large. By including about 0.4 mass % of the nickel powder in the green compact, the sintering temperature is lowered to 1400° C. when the molybdenum powder is used, and the sintering temperature is lowered to 1500° C. when the tungsten powder is used. Even in each case, the electrode can have a density ratio of 80% or more, the thermal energy used in the sintering process can be reduced, and the damage of the furnace can be inhibited. However, if the electrode includes more than 2 mass %, a Ni-rich portion (Ni-rich phase) is generated on the surface of the electrode, and the area of Mo or W is decreased, so that the electric discharge characteristics are deteriorated. Therefore, the electrode for cold cathode fluorescent lamps should include more than 0 mass % and 2 mass % or less of nickel.

Since nickel easily volatilizes, when the sintering atmosphere is reductive atmosphere or pressure reduction atmosphere which includes an inert gas as a carrier gas and has a pressure of 15 kPa or more, the volatilization of nickel is prevented. In this case, amount of nickel is preferably more than 0 mass % and 2 mass % or less, which range is same as the above case. However, when the sintering is performed in a pressure reduction atmosphere (that is, vacuum atmosphere) which has a pressure of less than 15 kPa, the nickel powder should be added in consideration with the amount of nickel which is lost by volatilization. In this case, the amount of nickel is preferably 0.5 to 4.0 mass %.

The nickel powder preferably has a particle size of 15 μm or less in the same manner as the above molybdenum powder or the tungsten powder. The nickel powder preferably has an approximately or almost spherical shape in the same manner as the above molybdenum powder or the tungsten powder. That is, the nickel powder has a tap density of 3.00 mg/m$^3$ or more.

Effects and advantages obtained by adding nickel powder are described above. Since the wettability of the nickel liquid phase is insufficient for a molybdenum carbide or a tungsten carbide, when the amount of the binder components which remains in the binder removal process and are used for maintaining the form the green compact is large, the amount of the molybdenum carbide or the tungsten carbide is increased. As a result, a Ni rich portion (Ni rich phase) is easily formed. Therefore, when nickel is used, the amount of C in the electrode for cold cathode fluorescent lamps should be 0.15 mass % or less.

EMBODIMENTS

Embodiment 1

Figure 2:
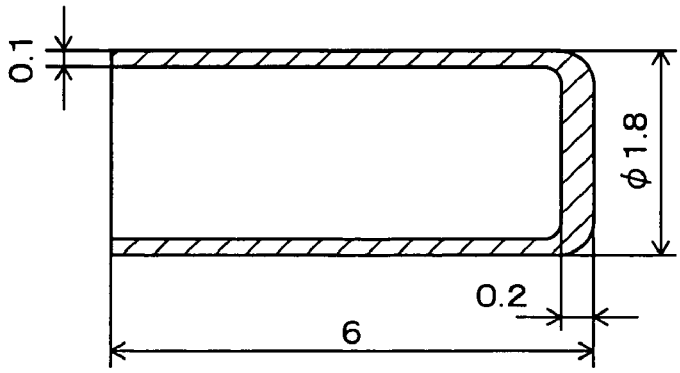
FIG. 2 is a cross sectional view showing an electrode for a cold cathode fluorescent lamp.

Mo powders having particle sizes and tap densities shown in Table 1 were prepared. Polyacetal having a softening point of 110° C. and a melting point of 180° C. and paraffin wax having a softening point of 39° C. and a melting point of 61° C. were mixed at a ratio of 4:6 to form a binder. The powder and the binder were mixed and kneaded at a ratio shown in Table 1 to prepare a raw material, and it was formed into a pellet. The pellet was heated to 200° C., inserted into a die which was hearted to a temperature shown in Table 1, and compacted by the die. Then, the material in the die was cooled to a temperature shown in Table 1, and ejected from the die, whereby a cup-shaped green compact shown in FIG. 2 was obtained. The green compact was heated to 250° C. and maintained at the temperature for 60 minutes, then further heated to 450° C. and maintained at the temperature for 60 minutes, thereby removing the binder. Then, the green compact was sintered in argon gas at 1800° C. for 60 minutes and cup-shaped sintered compact was obtained. Density ratio of the sintered compact was measured and appearance thereof was evaluated. A cold cathode fluorescent lamp was manufactured with the cup-shaped sintered compact, and discharge voltage to obtain discharge current of 9 mA. The results of these evaluations were shown in Table 1.

TABLE 1

| | Mixing Ratio volume % | | | | Compacting Process | Ejecting Process | | | | |
|---|---|---|---|---|---|---|---|---|---|---|
| | Mo powder | | | | Heating | Cooling | Evaluation Item | | | |
| Sample Number | | Particle Diameter μm | Tap Density Mg/m$^3$ | Binder | Temperature of Die ° C. | Temperature ° C. | Density Ratio % | Appearance Evaluation | Discharge Voltage mV | Notes |
| 01 | 70.0 | 3 | 3.0 | 30.0 | 140 | 40 | — | NG | — | Unable to produce pellet |
| 02 | 60.0 | 3 | 3.0 | 40.0 | 140 | 40 | 94 | Good | 364 | |
| 03 | 50.0 | 3 | 3.0 | 50.0 | 140 | 40 | 91 | Good | 360 | |
| 04 | 40.0 | 3 | 3.0 | 60.0 | 140 | 40 | 86 | Good | 359 | |
| 05 | 30.0 | 3 | 3.0 | 70.0 | 140 | 40 | 71 | NG | — | Large deformation in sintering process |
| 06 | 50.0 | 1 | 3.0 | 50.0 | 140 | 40 | 96 | Good | 365 | |
| 03 | 50.0 | 3 | 3.0 | 50.0 | 140 | 40 | 91 | Good | 360 | |
| 07 | 50.0 | 5 | 3.0 | 50.0 | 140 | 40 | 85 | Good | 357 | |
| 08 | 50.0 | 10 | 3.0 | 50.0 | 140 | 40 | 80 | Good | 355 | |
| 09 | 50.0 | 15 | 3.0 | 50.0 | 140 | 40 | 74 | NG | — | Decrease in density Uneveness in size |

TABLE 1-continued

| Sample Number | Mixing Ratio volume % Mo powder | Particle Diameter μm | Tap Density Mg/m³ | Binder | Compacting Process Heating Temperature of Die ° C. | Ejecting Process Cooling Temperature ° C. | Evaluation Item Density Ratio % | Appearance Evaluation | Discharge Voltage mV | Notes |
|---|---|---|---|---|---|---|---|---|---|---|
| 10 | 50.0 | 3 | 2.0 | 50.0 | 140 | 40 | 75 | NG | — | Decrease in density Uneveness in size |
| 03 | 50.0 | 3 | 3.0 | 50.0 | 140 | 40 | 91 | Good | 360 | |
| 11 | 50.0 | 3 | 5.0 | 50.0 | 140 | 40 | 95 | Good | 364 | |
| 12 | 50.0 | 3 | 3.0 | 50.0 | 100 | 40 | — | NG | — | Unable to flow raw material |
| 13 | 50.0 | 3 | 3.0 | 50.0 | 110 | 40 | 81 | Good | 355 | |
| 03 | 50.0 | 3 | 3.0 | 50.0 | 140 | 40 | 91 | Good | 360 | |
| 14 | 50.0 | 3 | 3.0 | 50.0 | 160 | 40 | 90 | Good | 360 | |
| 15 | 50.0 | 3 | 3.0 | 50.0 | 180 | 40 | — | NG | — | Breakage of form |
| 16 | 50.0 | 3 | 3.0 | 50.0 | 140 | 30 | — | NG | — | Generation of crack |
| 03 | 50.0 | 3 | 3.0 | 50.0 | 140 | 40 | 91 | Good | 360 | |
| 17 | 50.0 | 3 | 3.0 | 50.0 | 140 | 60 | 90 | Good | 359 | |
| 18 | 50.0 | 3 | 3.0 | 50.0 | 140 | 80 | — | NG | — | Breakage of form |

Samples Nos. 01 to 05 are examples in which a Mo powder was used as a metal powder and affect of amount of binder was examined. In sample No. 1 in which amount of the binder is less than 40% by volume, a pellet could not be formed since amount of binder was small. In contrast, in samples Nos. 02, 03, and 04 in which amount of the binder was 40% by volume or more, a pellet was formed and cup-shaped sintered compact with high density, good appearance, and thin and small size was formed through compacting and sintering. However, in sample No. 05 in which amount of the binder is more than 60% by volume, the sample was broken in sintering for volatilizing and removing the binder, the cup-shaped sample was deformed. Thus, it was confirmed that a cup-shaped sample with high density and good appearance could be obtained when amount of binder was 40 to 60% by volume. In this amount of the binder, discharge voltage to obtain discharge current of 9 mA was advantageously low at about 360 mV. It should be noted that "Good" in Table 1 is the case in which the sample had the size as designed and smooth surface and "NG" is the case other than "Good".

Samples Nos. 03 and 06 to 09 are examples in which affect of particle size of the Mo powder was examined. In samples Nos.03 and 06 to 08 of which each particle size was 10 μm or less, cup-shaped sintered compact with high density and good appearance was obtained. In contrast, in sample No. 09 of which particle size was more than 10 μm, fillability of the Mo powder was decreased, density of cup-shaped sintered compact was decreased, size of cup-shaped sintered compact was uneven. Thus, it was confirmed that a cup-shaped sample with thin and small size could be obtained when diameter of Mo powder was 10 μm or less. In this diameter of Mo powder, discharge voltage was advantageously low at about 360 mV.

Samples Nos. 03, 10, and 11 are examples in which affect of tap density of the Mo powder was examined. In sample No. 10 having tap density of less than 3.0 Mg/m$^3$, fillability of the Mo powder was decreased, density of cup-shaped sintered compact was decreased, size of cup-shaped sintered compact was uneven. In contrast, in samples Nos. 03 and 11 having tap density of 3.0 Mg/m$^3$ or more, fillability of the Mo powder was good, and cup-shaped sintered compact with high density and good appearance was obtained. Thus, it was confirmed that Mo powder should have a tap density of 3.0 Mg/m$^3$ or more. In this tap density of Mo powder, discharge voltage was advantageously low at about 360 mV.

Samples Nos. 03 and 12 to 15 are examples in which affect of heating temperature of die was examined. In sample No. 12, although pellet as raw material was heated to 200° C., heating temperature of die was lower than the softening point of the resin included in the binder. In compacting of sample No. 12, since amount of the raw material was small, temperature of the raw material was lower than the softening point of the resin, and fillability of the raw material was decreased. Therefore, reliable green compact was not obtained. In contrast, in samples Nos. 03, 13, and 14 of which each heating temperature of die was the softening point of the resin or higher and was lower than the melting point of the resin, cup-shaped sample with high density and good appearance was obtained. However, in sample No. 15 of which heating temperature of die was the melting point of the resin or higher, the binder was adhered to the die, the sample was broken in ejecting. Thus, it was confirmed that heating temperature of die was the softening point of the resin or higher and was lower than the melting point of the resin included in the binder. In this heating temperature of die, discharge voltage was advantageously low at about 360 mV.

Samples Nos. 03 and 16 to 18 are examples in which affect of the cooling temperature in ejecting was examined. In sample No. 15 of which cooling temperature of die in ejecting, which approximately corresponds to temperature of green compact in ejecting, was lower than the softening point of the wax included in the binder, the lubricity of the wax was decreased, cracks were generated in ejecting. In contrast, in samples Nos. 03 and 16 of which each cooling temperature in ejecting was the softening point of the wax or more and was the melting point of the wax or lower, the lubricity of the wax was exhibited well, and good ejecting was performed. However, in sample No. 18 of which cooling temperature in ejecting was higher than the melting point of the wax, the raw material was maintained to be softened in ejecting, and the green compact was broken in ejecting. Thus, it was confirmed that cooling temperature in ejecting was the softening point of the wax or higher and was lower than the melting point of the wax included in the binder. In this cooling temperature of die, discharge voltage was advantageously low at about 360 mV.

Embodiment 2

Mo powders having particle sizes and tap densities shown in Table 2 were prepared. The same binders as those of Embodiment 1 were prepared. The powder and the binder were mixed and kneaded at a ratio shown in Table 2 to prepare a raw material, and it was formed into a pellet. The pellet was heated to 200° C., inserted into a die which was hearted to a temperature shown in Table 2, and compacted by the die. Then, the material in the die was cooled to a temperature shown in Table 2, and ejected from the die, whereby a cup-shaped green compact shown in FIG. 2 was obtained. The green compact was heated to 250° C. and maintained at the temperature for 60 minutes, then further heated to 450° C. and maintained at the temperature for 60 minutes, thereby removing the binder. Then, the green compact was sintered in argon gas at 2000° C. for 60 minutes and cup-shaped sintered compact was obtained. Density ratio of the sintered compact was measured and appearance thereof was evaluated. A cold cathode fluorescent lamp was manufactured with the cup-shaped sintered compact, and discharge voltage to obtain discharge current of 9 mA. The results of these evaluations were shown in Table 2.

30 to 33 are examples in which affect of heating temperature of die was examined. Samples Nos. 21 and 34 to 36 are examples in which affect of cooling temperature in ejecting was examined. In each sample, the same tendencies as in each sample of Embodiment 1 using Mo powder were observed. That is, it was confirmed that amount of binder should be 40 to 60% by volume. W powder should have a particle size of 10 μm or less and a tap density of 5.6 Mg/m$^3$ or more. It was confirmed that heating temperature of die should be the softening point of the resin or higher and was lower than the melting point of the resin included in the binder. It was confirmed that cooling temperature in ejecting should be the softening point of the wax or higher and was lower than the melting point of the wax included in the binder.

Embodiment 3

Mo powders having particle sizes of 3 μm and tap densities of 3.0 Mg/m$^3$ were prepared. The same binders as those of Embodiment 1 were prepared. The powder and the binder were mixed and kneaded at a ratio of 5:5 by volume to prepare a raw material, and it was formed into a pellet. The pellet was heated to 200° C., inserted into a die which was hearted to 140° C., and compacted by the die. Then, the material in the die was cooled to 40° C., and ejected from the die, whereby a cup-shaped green compact shown in FIG. 2 was obtained.

TABLE 2

| Sample Number | Mixing Ratio volume % W powder | Particle Diameter μm | Tap Density Mg/m$^3$ | Binder | Compacting Process Heating Temperature of Die ° C. | Ejecting Process Cooling Temperature ° C. | Evaluation Item Density Ratio % | Appearance Evaluation | Discharge Voltage mV | Notes |
|---|---|---|---|---|---|---|---|---|---|---|
| 19 | 70.0 | 3 | 5.6 | 30.0 | 140 | 40 | — | NG | — | Unable to produce pellet |
| 20 | 60.0 | 3 | 5.6 | 40.0 | 140 | 40 | 94 | Good | 370 | |
| 21 | 50.0 | 3 | 5.6 | 50.0 | 140 | 40 | 90 | Good | 367 | |
| 22 | 40.0 | 3 | 5.6 | 60.0 | 140 | 40 | 85 | Good | 365 | |
| 23 | 30.0 | 3 | 5.6 | 70.0 | 140 | 40 | 70 | NG | — | Large deformation in sintering process |
| 24 | 50.0 | 1 | 5.6 | 50.0 | 140 | 40 | 95 | Good | 372 | |
| 21 | 50.0 | 3 | 5.6 | 50.0 | 140 | 40 | 90 | Good | 367 | |
| 25 | 50.0 | 5 | 5.6 | 50.0 | 140 | 40 | 85 | Good | 366 | |
| 26 | 50.0 | 10 | 5.6 | 50.0 | 140 | 40 | 79 | Good | 363 | |
| 27 | 50.0 | 15 | 5.6 | 50.0 | 140 | 40 | 73 | NG | — | Decrease in density Uneveness in size |
| 28 | 50.0 | 3 | 3.0 | 50.0 | 140 | 40 | 75 | NG | — | Decrease in density Uneveness in size |
| 21 | 50.0 | 3 | 5.6 | 50.0 | 140 | 40 | 90 | Good | 367 | |
| 29 | 50.0 | 3 | 7.0 | 50.0 | 140 | 40 | 95 | Good | 371 | |
| 30 | 50.0 | 3 | 5.6 | 50.0 | 100 | 40 | — | NG | — | Unable to flow raw material |
| 31 | 50.0 | 3 | 5.6 | 50.0 | 110 | 40 | 80 | Good | 365 | |
| 21 | 50.0 | 3 | 5.6 | 50.0 | 140 | 40 | 90 | Good | 367 | |
| 32 | 50.0 | 3 | 5.6 | 50.0 | 160 | 40 | 89 | Good | 367 | |
| 33 | 50.0 | 3 | 5.6 | 50.0 | 180 | 40 | — | NG | — | Breakage of form |
| 34 | 50.0 | 3 | 5.6 | 50.0 | 140 | 30 | — | NG | — | Generation of crack |
| 21 | 50.0 | 3 | 5.6 | 50.0 | 140 | 40 | 90 | Good | 367 | |
| 35 | 50.0 | 3 | 5.6 | 50.0 | 140 | 60 | 90 | Good | 366 | |
| 36 | 50.0 | 3 | 5.6 | 50.0 | 140 | 80 | — | NG | — | Breakage of form |

Samples Nos. 19 to 23 are examples in which a W powder was used as a metal powder and affect of amount of binder was examined. Samples Nos. 21 and 24 to 27 are examples in which affect of particle size of W powder was examined. Samples Nos. 21, 28, and 29 are examples in which affect of tap density of W powder was examined. Samples Nos. 21 and The green compact was heated to 250° C. and maintained at the temperatures in first step, then further heated to 450° C. and maintained at the temperature in second step, thereby removing the binder. In this case, constant temperature times of the above temperature were varied as shown in Table 3. Then, the green compact was sintered in argon gas at 1800° C.

for 60 minutes and cup-shaped sintered compact was obtained. C in the sintered compact was analyzed, and amount of C therein was measured. Appearance of the sintered compact was evaluated. A cold cathode fluorescent lamp was manufactured with the cup-shaped sintered compact, and discharge voltage to obtain discharge current of 9 mA. In addition, amount of C in sample No. 03 of Embodiment 1 was measured. The results of these evaluations were shown in Table 3.

TABLE 3

| Sample | Constant Temperature Time min | | Evaluation Item | | | | |
|---|---|---|---|---|---|---|---|
| | | | Amount of C | Density | Appearance | Discharge Voltage | |
| Number | 250° C. | 450° C. | mass % | Ratio % | Evaluation | mV | Notes |
| 37 | 20 | 20 | 1.800 | 75 | NG | — | Decrease in density<br>Breakage of form after sintering process |
| 38 | 30 | 30 | 0.500 | 87 | Good | 354 | |
| 39 | 45 | 45 | 0.150 | 89 | Good | 357 | |
| 03 | 60 | 60 | 0.090 | 91 | Good | 360 | Embodiment 1 |
| 40 | 90 | 90 | 0.030 | 93 | Good | 361 | |
| 41 | 120 | 120 | 0.018 | 95 | Good | 362 | |
| 42 | 180 | 180 | 0.010 | 95 | Good | 362 | |
| 43 | 300 | 300 | 0.005 | — | NG | — | Breakage of form after binder removal process |

As shown in Table 3, the shorter the constant temperature time in binder removal, the larger the amount of C remaining in the sintered compact. In reverse, the longer the constant temperature time in binder removal, the smaller the amount of C remaining in the sintered compact. In sample No. 37 in which more than 0.5 mass % of C remained in the sintered compact, densification by sintering was prevented by carbide formed on surface of Mo powder, the density ratio was small, and the sample after sintering was broken in handling. In contrast, in sample No. 38 in which 0.5 mass % of C remained in the sintered compact, the density ratio was sufficient, and breakage of the sample after sintering was prevented in handling. However, in sample No. 43 in which less than 0.01 mass % of C remained in the sintered compact, the amount of the residual binder after binder removal was small, the sample after binder removal was broken. Thus, it was confirmed that amount of C in sintered compact should be 0.01 to 0.5 mass %. It was confirmed that first step and second step in binder removal have effectively constant temperature time of 30 to 180 minutes.

Embodiment 4

Mo powders having particle sizes of 3 μm and tap densities of 5.6 $Mg/m^3$ were prepared. The same binders as those of Embodiment 1 were prepared. The powder and the binder were mixed and kneaded at a ratio of 5:5 by volume to prepare a raw material, and it was formed into a pellet. The pellet was heated to 200° C., inserted into a die which was hearted to 140° C., and compacted by the die. Then, the material in the die was cooled to 40° C., and ejected from the die, whereby a cup-shaped green compact shown in FIG. 2 was obtained. The green compact was heated to 250° C. and maintained at the temperature in first step, then further heated to 450° C. and maintained at the temperature in second step, thereby removing the binder. In this case, constant temperature times of the above temperatures were varied as shown in Table 4. Then, the green compact was sintered in argon gas at 2000° C. for 60 minutes and cup-shaped sintered compact was obtained. C in the sintered compact was analyzed, and amount of C therein was measured. Appearance thereof was evaluated. A cold cathode fluorescent lamp was manufactured with the cup-shaped sintered compact, and discharge voltage to obtain discharge current of 9 mA. In addition, amount of C in sample No. 21 of Embodiment 2 was measured. The results of these evaluations were shown in Table 4.

TABLE 4

| Sample | Constant Temperature Time min | | Evaluation Item | | | | |
|---|---|---|---|---|---|---|---|
| | | | Amount of C | Density | Appearance | Discharge Voltage | |
| Number | 250° C. | 450° C. | mass % | Ratio % | Evaluation | mV | Notes |
| 44 | 20 | 20 | 1.760 | 75 | NG | — | Decrease in density<br>Breakage of form after sintering process |
| 45 | 30 | 30 | 0.500 | 85 | Good | 365 | |
| 46 | 45 | 45 | 0.151 | 88 | Good | 366 | |
| 21 | 60 | 60 | 0.089 | 90 | Good | 367 | Embodiment 2 |
| 47 | 90 | 90 | 0.031 | 92 | Good | 367 | |

TABLE 4-continued

| Sample | Constant Temperature Time min | | Evaluation Item | | | | |
|---|---|---|---|---|---|---|---|
| Number | 250° C. | 450° C. | Amount of C mass % | Density Ratio % | Appearance Evaluation | Discharge Voltage mV | Notes |
| 48 | 120 | 120 | 0.017 | 94 | Good | 368 | |
| 49 | 180 | 180 | 0.011 | 94 | Good | 368 | |
| 50 | 300 | 300 | 0.006 | — | NG | — | Breakage of form after binder removal process |

As shown in Table 4, in the same manner as in the case in which Mo powder was formed into an electrode for cold cathode fluorescent lamp, the shorter the constant temperature time in binder removal, the larger the amount of C remaining in the sintered compact. In reverse, the longer the constant temperature time in binder removal, the smaller the amount of C remaining in the sintered compact. In sample No. 44 in which more than 0.5 mass % of C remained in the sintered compact, densification by sintering was prevented by carbide formed on surface of W powder, the density ratio was small, and the sample after sintering was broken in handling. In contrast, in sample No. 45 in which 0.5 mass % of C remained in the sintered compact, the density ratio was sufficient, and breakage of the sample after sintering was prevented in handling. However, in sample No. 50 in which less than 0.01 mass % of C remained in the sintered compact, the amount of the residual binder after binder removal was small, and the sample after binder removal was broken. Thus, it was confirmed that amount of C in sintered compact should be 0.01 to 0.5 mass %. It was confirmed that first step and second step in binder removal have effectively constant temperature time of 30 to 180 minutes.

Embodiment 5

Mo powders having particle sizes of 3 μm and tap densities of 3.0 $Mg/m^3$ were prepared. The same binders as those of Embodiment 1 were prepared. The powder and the binder were mixed and kneaded at a ratio of 5:5 by volume to prepare a raw material, and it was formed into a pellet. The pellet was heated to 200° C., inserted into a die which was hearted to 140° C., and compacted by the die. Then, the material in the die was cooled to a temperature of 40° C., and ejected from the die, whereby a cup-shaped green compact shown in FIG. 2 was obtained. The green compact was heated to 250° C. and maintained at the temperature for 60 minutes, then further heated to 450° C. and maintained at the temperature for 60 minutes, thereby removing the binder: Then, the green compact was sintered in argon gas at a temperature shown in Table 5 for 60 minutes and cup-shaped sintered compact was obtained. C in the sintered compact was analyzed, and amount of C therein was measured. Appearance of the sintered compact was evaluated. A cold cathode fluorescent lamp was manufactured with the cup-shaped sintered compact, and discharge voltage to obtain discharge current of 9 mA. In addition, amount of C in sample No. 03 of Embodiment 1 was measured. The results of these evaluations were shown in Table 5.

TABLE 5

| Sample Number | Sintering Temperature ° C. | Evaluation Item Density Ratio % | Appearance Evaluation | Discharge Voltage mV | Notes |
|---|---|---|---|---|---|
| 51 | 1400 | 71 | NG | — | Decrease in density<br>Breakage of edge portion |
| 52 | 1500 | 80 | Good | 354 | |
| 03 | 1800 | 91 | Good | 360 | Embodiment 1 |
| 53 | 2000 | 95 | Good | 364 | |
| 54 | 2200 | 96 | Good | 364 | |
| 55 | 2500 | 98 | Good | 366 | |

As shown in Table 5, the higher the sintering temperature, the higher the density ratio. In sample No. 51 of which density ratio was lower than 80% due to low sintering temperature, edge portion of the sample was broken in manufacturing the cold cathode fluorescent lamp. In contrast, samples No. 03, and 52 to 54 which each density ratio was 80 to 96% had good appearance and exhibited good electric discharge characteristics. However, in sample No. 55 of which density ratio was more than 96%, independent pores were increased, so that hollow cathode effect was decreased, and electric discharge voltage was increased. Thus, it was confirmed that density ratio should be 80 to 96%. When Mo powder is formed into an electrode for cathode fluorescent lamp, sintering temperature is preferably 1500 to 2200° C.

Embodiment 6

W powders having particle sizes of 3 μm and tap densities of 5.6 $Mg/m^3$ were prepared. The same binders as those of Embodiment 1 were prepared. The powder and the binder were mixed and kneaded at a ratio of 5:5 by volume to prepare a raw material, and it was formed into a pellet. The pellet was heated to 200° C., inserted into a die which was hearted to 140° C., and compacted by the die. Then, the material in the die was cooled to 40° C., and ejected from the die, whereby a cup-shaped green compact shown in FIG. 2 was obtained.

The green compact was heated to 250° C. and maintained at the temperature for 60 minutes, then further heated to 450° C. and maintained at the temperature for 60 minutes, thereby removing the binder. Then, the green compact was sintered in argon gas at a temperature shown in Table 6 for 60 minutes and cup-shaped sintered compact was obtained. C in the sintered compact was analyzed, and amount of C therein was measured. Appearance of the sintered compact was evaluated. A cold cathode fluorescent lamp was manufactured with the cup-shaped sintered compact, and discharge voltage to obtain discharge current of 9 mA. In addition, amount of C in sample No. 21 of Embodiment 2 was measured. The results of these evaluations were shown in Table 6.

TABLE 6

| Sample Number | Sintering Temperature ° C. | Evaluation Item: Density Ratio % | Evaluation Item: Appearance Evaluation | Evaluation Item: Discharge Voltage mV | Notes |
|---|---|---|---|---|---|
| 56 | 1500 | 73 | NG | — | Decrease in density<br>Breakage of edge portion |
| 57 | 1700 | 80 | Good | 362 | |
| 21 | 2000 | 90 | Good | 367 | Embodiment 2 |
| 58 | 2200 | 93 | Good | 368 | |
| 59 | 2400 | 96 | Good | 369 | |
| 60 | 2600 | 98 | Good | 370 | |

As shown in Table 6, in the same manner as in the case in which Mo powder was formed into an electrode for cold cathode fluorescent lamp, the higher the sintering temperature, the higher the density ratio. In sample No. 56 of which density ratio was lower than 80% due to low sintering temperature, edge portion of the sample was broken in manufacturing the cold cathode fluorescent lamp. In contrast, samples No. 21, and 57 to 59 of which each density ratio was 80 to 96% had good appearance and exhibited good electric discharge characteristics. However, in sample No. 60 of which density ratio was more than 96%, independent pores were increased, so that hollow cathode effect was decreased, and electric discharge voltage was increased. Thus, it was confirmed that density ratio should be 80 to 96%. When W powder is formed into an electrode for cathode fluorescent lamp, sintering temperature is preferably 1600 to 2400° C.

Embodiment 7

Mo powders having particle sizes of 3 μm and tap densities of 3.0 $Mg/m^3$ were prepared. Ni powders having particle sizes of 10 μm and tap densities of 3.0 $Mg/m^3$ were prepared. The same binders as those of Embodiment 1 were prepared. The powders and the binder were mixed and kneaded at a ratio shown in Table 7 to prepare a raw material, and it was formed into a pellet. The pellet was heated to 200° C., inserted into a die which was hearted to a temperature of 140° C., and compacted by the die. Then, the material in the die was cooled to a temperature of 40° C., and ejected from the die, whereby a cup-shaped green compact shown in FIG. 2 was obtained. The green compact was heated to 250° C. and maintained at the temperature for 60 minutes, then further heated to 450° C. and maintained at the temperature for 60 minutes, thereby removing the binder. Then, the green compact was sintered at a temperature shown in Table 7 in a reduction atmosphere having a pressure shown in Table 7 for 60 minutes and cup-shaped sintered compact was obtained. The pressure was controlled by amount of argon gas supplied as a carrier gas. Density ratio of the sintered compact was measured and appearance of the cup-shaped sintered compact was evaluated. A cold cathode fluorescent lamp was manufactured with the cup-shaped sintered compact, and discharge voltage to obtain discharge current of 9 mA. The results of these evaluations were shown in Table 7.

TABLE 7

| Sample Number | Mixing Ratio volume %: Metal Powder | Mixing Ratio mass %: Mo Powder | Mixing Ratio mass %: Ni powder | Mixing Ratio mass %: Binder | Sintering Process: Sintering Temperature ° C. | Sintering Process: Atmosphere Pressure Pa | Evaluation Item: Amount of Ni mass % | Evaluation Item: Density Ratio % | Evaluation Item: Appearance Evaluation | Evaluation Item: Discharge Voltage mV | Notes |
|---|---|---|---|---|---|---|---|---|---|---|---|
| 51 | 50.0 | 100.0 | 0.0 | 50.0 | 1400 | 1 | 0.0 | 71 | NG | — | Example 5 |
| 61 | 50.0 | 99.5 | 0.5 | 50.0 | 1400 | 1 | 0.3 | 82 | Good | 361 | |
| 62 | 50.0 | 99.0 | 1.0 | 50.0 | 1400 | 1 | 0.5 | 86 | Good | 370 | |
| 63 | 50.0 | 98.5 | 1.5 | 50.0 | 1400 | 1 | 0.8 | 92 | Good | 379 | |
| 64 | 50.0 | 97.0 | 3.0 | 50.0 | 1400 | 1 | 1.3 | 93 | Good | 383 | |
| 65 | 50.0 | 94.0 | 6.0 | 50.0 | 1400 | 1 | 2.0 | 96 | Good | 400 | |
| 66 | 50.0 | 93.0 | 7.0 | 50.0 | 1400 | 1 | 2.3 | 98 | Good | 408 | Wear |
| 67 | 50.0 | 98.5 | 1.5 | 50.0 | 1200 | 1 | 0.8 | 75 | NG | — | Decrease in density |
| 68 | 50.0 | 98.5 | 1.5 | 50.0 | 1250 | 1 | 0.8 | 80 | Good | 360 | |
| 63 | 50.0 | 98.5 | 1.5 | 50.0 | 1400 | 1 | 0.8 | 92 | Good | 379 | |

TABLE 7-continued

| Sample Number | Mixing Ratio volume % | Metal Powder Mixing Ratio mass % Mo Powder | Ni powder | Binder | Sintering Process Sintering Temperature ° C. | Atmosphere Pressure Pa | Evaluation Item Amount of Ni mass % | Density Ratio % | Appearance Evaluation | Discharge Voltage mV | Notes |
|---|---|---|---|---|---|---|---|---|---|---|---|
| 69 | 50.0 | 98.5 | 1.5 | 50.0 | 1600 | 1 | 0.8 | 96 | Good | 407 | |
| 70 | 50.0 | 98.5 | 1.5 | 50.0 | 1800 | 1 | 0.8 | 98 | Good | 411 | |
| 63 | 50.0 | 98.5 | 1.5 | 50.0 | 1400 | 1 | 0.8 | 92 | Good | 379 | |
| 71 | 50.0 | 98.5 | 1.5 | 50.0 | 1400 | $15 \times 10^3$ | 1.5 | 94 | Good | 386 | |
| 72 | 50.0 | 98.5 | 1.5 | 50.0 | 1400 | $50 \times 10^3$ | 1.5 | 94 | Good | 386 | |

As shown in Table 7, samples Nos. 61 to 71 are examples formed such that Mo powder and Ni powder as metal powder were mixed and sintered at 1400° C. In sample No. 51 (in Embodiment 5) formed by using Mo powder and no Ni powder, since sintering temperature was 1400° C., sintering was insufficient and density ratio was low, so that edge portion of the sample was broken in manufacturing the cold cathode fluorescent lamp. However, in sample No. 61 which was formed by using 0.5 mass % of Ni powder and of which sintered compact included 0.3 mass % of Ni, density ratio was increased in comparison with that of sample No. 51 which was formed by using no Ni powder, sufficient density ratio of 82% was obtained although sintering temperature was 1400° C. The larger the amount of Ni in the sintered compact by increasing the mixed amount of Ni powder, the higher the density ratio, and samples Nos. 61 to 65 obtained sufficient density ratio although sintering temperatures thereof were lower than those of Embodiment 1. However, the electric discharge voltage to obtain discharge current of 9 mA gradually increased as mixing amount of Ni powder was large. Moreover, in sample No. 66 which was formed by using more than 6.0 mass % of Ni powder and of which sintered compact included more than 2.0 mass % of Ni, amount of Ni having a low melting point was large, and wear of electrode occurred. Therefore, in viewpoint of electric discharge, mixed amount of Ni powder should be 6.0 mass % or-less, and amount of Ni in sintered compact should be 2.0 mass % or less. Thus, it was confirmed that the effects could be obtained when amount of Ni in sintered compact was 2.0 mass % or less since sintering temperature was lowered by mixing of Ni powder but discharge voltage was greatly increased by excessive mixing thereof. It was confirmed that mixed amount of Ni powder should be 0.5 to 6.0 mass %.

As shown in Table 7, samples Nos. 63 and 60 to 70 are examples used for examining where sintering temperature can be reduced and cannot be reduced. When sintering temperature was decreased to 1200° C. as shown in sample No. 67, sintering was insufficiently performed although Ni powder was mixed, so that density ratio of sintered compact was only less than 80%. In contrast, in samples of which each sintering temperature was 1250° C. or more, sufficient density ratio was obtained, and when the sintering temperature was higher, the density ratio was much higher. However, in sample No. 70 having density ratio of more than 96%, independent pores were increased, the hollow cathode effect was small, and discharge voltage was increased. Thus, it was confirmed that density ratio should be 96% or less.

As shown in Table 7, samples Nos. 63, 71 and 72 were used for examining affect of temperature of pressure reduction atmosphere. In the above embodiment, since pressure reduction atmosphere (vacuum atmosphere) having a low pressure was used, a portion of mixed Ni powder was volatilized, amount of Ni in sintered compact was decreased. However, as shown in samples Nos. 71 and 72, it was confirmed that total amount of mixed Ni powder was not volatilized and was equal to that of Ni in sintered compact by setting pressure of 15 kPa or more pressure reduction atmosphere.

Embodiment 8

W powders having particle sizes of 3 μm and tap densities of 5.6 $Mg/m^3$ were prepared. Ni powders having particle sizes of 10 μm and tap densities of 3.0 $Mg/m^3$ were prepared. The same binders as those of Embodiment 1 were prepared. The powders and the binder were mixed and kneaded at a ratio shown in Table 8 to prepare a raw material, and it was formed into a pellet. The pellet was heated to 200° C., inserted into a die which was hearted to 140° C., and compacted by the die. Then, the material in the die was cooled to 40° C., and ejected from the die, whereby a cup-shaped green compact shown in FIG. 2 was obtained. The green compact was heated to 250° C. and maintained at the temperature for 60 minutes, then further heated to 450° C. and maintained at the temperature for 60 minutes, thereby removing the binder. Then, the green compact was sintered at a temperature shown in Table 8 in a reduction atmosphere having a pressure shown in Table 8 for 60 minutes and cup-shaped sintered compact was obtained. The pressure was controlled by amount of argon gas supplied as a carrier gas. Density ratio of the sintered compact was measured and appearance of the cup-shaped sintered compact was evaluated. A cold cathode fluorescent lamp was manufactured with the cup-shaped sintered compact, and discharge voltage to obtain discharge current of 9 mA. The results of these evaluations were shown in Table 8.

TABLE 8

| Sample Number | Mixing Ratio volume % | Metal Powder Mixing Ratio mass % W Powder | Ni powder | Binder | Sintering Process Sintering Temperature ° C. | Atmosphere Pressure Pa | Evaluation Item Amount of Ni mass % | Density Ratio % | Appearance Evaluation | Discharge Voltage mV | Notes |
|---|---|---|---|---|---|---|---|---|---|---|---|
| 56 | 50.0 | 100.0 | 0.0 | 50.0 | 1500 | 1 | 0.0 | 70 | NG | — | Embodiment 6 |
| 73 | 50.0 | 99.5 | 0.5 | 50.0 | 1500 | 1 | 0.3 | 81 | Good | 365 | |
| 74 | 50.0 | 99.0 | 1.0 | 50.0 | 1500 | 1 | 0.5 | 85 | Good | 376 | |
| 75 | 50.0 | 98.5 | 1.5 | 50.0 | 1500 | 1 | 0.8 | 90 | Good | 387 | |
| 76 | 50.0 | 97.0 | 3.0 | 50.0 | 1500 | 1 | 1.3 | 93 | Good | 402 | |
| 77 | 50.0 | 94.0 | 6.0 | 50.0 | 1500 | 1 | 2.0 | 96 | Good | 416 | |
| 78 | 50.0 | 93.0 | 7.0 | 50.0 | 1500 | 1 | 2.3 | 98 | Good | 420 | Wear |
| 79 | 50.0 | 98.5 | 1.5 | 50.0 | 1300 | 1 | 0.8 | 73 | NG | — | Decrease in density |
| 80 | 50.0 | 98.5 | 1.5 | 50.0 | 1350 | 1 | 0.8 | 80 | Good | 381 | |
| 75 | 50.0 | 98.5 | 1.5 | 50.0 | 1500 | 1 | 0.8 | 90 | Good | 387 | |
| 81 | 50.0 | 98.5 | 1.5 | 50.0 | 1800 | 1 | 0.8 | 96 | Good | 423 | |
| 82 | 50.0 | 98.5 | 1.5 | 50.0 | 2000 | 1 | 0.8 | 98 | Good | 425 | |
| 75 | 50.0 | 98.5 | 1.5 | 50.0 | 1500 | 1 | 0.8 | 90 | Good | 387 | |
| 83 | 50.0 | 98.5 | 1.5 | 50.0 | 1500 | $15 \times 10^3$ | 1.5 | 93 | Good | 402 | |
| 84 | 50.0 | 98.5 | 1.5 | 50.0 | 1500 | $50 \times 10^3$ | 1.5 | 93 | Good | 402 | |

As shown in Table 8, samples Nos. 56 (in Embodiment 6) and 73 to 78 are examples used for examining affect of mixing W powder with Ni powder as metal powder. Samples Nos. 75 and 79 to 82 are examples used for examining affect of sintering temperature when Ni powder was mixed. Samples Nos. 75, 83 and 84 are examples used for examining affect of pressure of pressure reduction atmosphere. In each sample, the same tendencies as in each sample of Embodiment 7 using Mo powder were observed. That is, sintering temperature was reduced by mixing of Ni powder but discharge voltage was greatly increased, so that amount of Ni in sintering compact should be 2.0 mass % or less. Amount of mixed Ni powder should be 0.5 to 6.0 mass % in pressure reduction atmosphere having a pressure of 15 kPa. Density ratio should be 96% or less. Therefore, sintering temperature is preferably 1350 to 1800° C. when Ni powder wais mixed. Volatilization of Ni could be prevented by using pressure reduction atmosphere having a pressure of 15 kPa or more and amount of Ni powder is equal to that of Ni in sintered compact.

Embodiment 9

Mo powders having particle sizes of 3 μm and tap densities of 3.0 Mg/m$^3$ were prepared. Ni powders having particle sizes of 10 μm and tap densities of 3.0 Mg/m$^3$ were prepared. The Mo powder and 0.2 mass % of the Ni powder were mixed into metal powder. The same binders as those of Embodiment 1 were prepared. The powder and the binder were mixed and kneaded at a ratio of 5:5 by volume to prepare a raw material, and it was formed into a pellet. The pellet was heated to 200° C., inserted into a die which was hearted to a temperature of 140° C., and compacted by the die. Then, the material in the die was cooled to a temperature of 40° C., and ejected from the die, whereby a cup-shaped green compact shown in FIG. 2 was obtained. The green compact was heated to 250° C. and maintained at the temperature in first step, then further heated to 450° C. and maintained at the temperature in second step, thereby removing the binder. In this case, constant temperature times of the above temperatures were varied as shown in Table 9. Then, the green compact was sintered at a temperature of 1800° C. in a reduction atmosphere (vacuum atmosphere) having a pressure of 1 Pa for 60 minutes and cup-shaped sintered compact was obtained. C in the sintered compact was analyzed, and amount of C therein was measured. Appearance of the sintered compact was evaluated. A cold cathode fluorescent lamp was manufactured with the cup-shaped sintered compact, and discharge voltage to obtain discharge current of 9 mA. In addition, amount of C in sample No. 63 of Embodiment 7 was measured. The results of these evaluations were shown in Table 9.

TABLE 9

| Sample Number | Constant Temperature Time min 250° C. | 450° C. | Evaluation Item Amount of C mass % | Density Ratio % | Appearance Evaluation | Discharge Voltage mV | Notes |
|---|---|---|---|---|---|---|---|
| 85 | 20 | 20 | 1.800 | 76 | NG | — | Decrease in density<br>Breakage of form after sintering process |
| 86 | 30 | 30 | 0.500 | 79 | NG | — | Decrease in density<br>Breakage of form after sintering process |
| 87 | 45 | 45 | 0.150 | 90 | Good | 377 | |

TABLE 9-continued

| Sample | Constant Temperature Time min | | Evaluation Item Amount of C | Density | Appearance | Discharge Voltage | |
|---|---|---|---|---|---|---|---|
| Number | 250° C. | 450° C. | mass % | Ratio % | Evaluation | mV | Notes |
| 63 | 60 | 60 | 0.090 | 92 | Good | 379 | Embodiment 7 |
| 88 | 90 | 90 | 0.030 | 93 | Good | 381 | |
| 89 | 120 | 120 | 0.018 | 95 | Good | 383 | |
| 90 | 180 | 180 | 0.010 | 95 | Good | 383 | |
| 91 | 300 | 300 | 0.005 | — | NG | — | Breakage of form after binder removal process |

As shown in Table 9, the shorter the constant temperature time in binder removal, the larger the amount of C remaining in the sintered compact. In reverse, the longer the constant temperature time in binder removal, the smaller the amount of C remaining in the sintered compact. In samples Nos. 85 and 86 in which more than 0.15 mass % of C remained in the sintered compact, densification by sintering was prevented by carbide formed on surface of Mo powder, the density ratio was small, and the sample after sintering was broken in handling. In contrast, in sample No. 87 in which 0.15 mass % of C remained in the sintered compact, the density ratio was sufficient, and breakage of the sample after sintering was prevented in handling. However, in sample No. 91 in which less than 0.01 mass % of C remained in the sintered compact, the amount of the residual binder after binder removal was small, the sample after binder removal was broken. Thus, it was confirmed that amount of C in sintered compact should be 0.01 to 0.15 mass %. It was confirmed that first step and second step in binder removal have effectively constant temperature time of 30 to 180 minutes.

Embodiment 10

W powders having particle sizes of 3 μm and tap densities of 3.0 Mg/m$^3$ were prepared. Ni powders having particle sizes of 10 μm and tap densities of 3.0 Mg/m$^3$ were prepared. The W powder and 1.5 mass % of the Ni powder were mixed into metal powder. The same binders as those of Embodiment 1 were prepared. The powder and the binder were mixed and kneaded at a ratio of 5:5 by volume to prepare a raw material, and it was formed into a pellet. The pellet was heated to 200° C., inserted into a die which was hearted to a temperature of 140° C., and compacted by the die. Then, the material in the die was cooled to a temperature of 40° C., and ejected from the die, whereby a cup-shaped green compact shown in FIG. 2 was obtained. The green compact was heated to 250° C. and maintained at the temperature in first step, then further heated to 450° C. and maintained at the temperature in second step, thereby removing the binder. In this case, constant temperature times of the above temperatures were varied as shown in Table 10. Then, the green compact was sintered at a temperature of 1800° C. in a reduction atmosphere having a pressure of 1 Pa for 60 minutes and cup-shaped sintered compact was obtained. C in the sintered compact was analyzed, and amount of C therein was measured. Appearance of the sintered compact was evaluated. A cold cathode fluorescent lamp was manufactured with the cup-shaped sintered compact, and discharge voltage to obtain discharge current of 9 mA. In addition, amount of C in sample No. 75 of Embodiment 8 was measured. The results of these evaluations were shown in Table 10.

TABLE 10

| Sample | Constant Temperature Time min | | Evaluation Item Amount of C | Density | Appearance | Discharge Voltage | |
|---|---|---|---|---|---|---|---|
| Number | 250° C. | 450° C. | mass % | Ratio % | Evaluation | mV | Notes |
| 92 | 20 | 20 | 1.760 | 75 | NG | — | Decrease in density<br>Breakage after sintering process |
| 93 | 30 | 30 | 0.500 | 78 | NG | — | Decrease in density<br>Breakage after sintering process |
| 94 | 45 | 45 | 0.151 | 89 | Good | 365 | |
| 75 | 60 | 60 | 0.089 | 90 | Good | 367 | Embodiment 8 |
| 95 | 90 | 90 | 0.031 | 92 | Good | 369 | |
| 96 | 120 | 120 | 0.017 | 94 | Good | 370 | |
| 97 | 180 | 180 | 0.011 | 95 | Good | 371 | |
| 98 | 300 | 300 | 0.006 | — | NG | — | Breakage of form after binder removal process. |

As shown in Table 10, in each sample in which W powder was mixed with Ni powder, the same tendencies as in each sample of Embodiment 9 in which Mo powder was mixed with Ni powder were observed. That is, the shorter the constant temperature time in binder removal, the larger the amount of C remaining in the sintered compact. In reverse, the longer the constant temperature time in binder removal, the smaller the amount of C remaining in the sintered compact. Thus, it was confirmed that amount of C in sintered compact should be 0.01 to 0.15 mass %. It was confirmed that first step and second step in binder removal have effectively constant temperature time of 30 to 180 minutes.

What is claimed is:

1. A production method for an electrode for a cold cathode fluorescent lamp, comprising:

preparing a metal powder composed of one of Mo and W, and a binder composed of a thermoplastic resin and a wax;

mixing the metal powder and 40 to 60 volume % of the binder with respect to the metal powder into a mixed powder;

heating and kneading the mixed powder into a raw material;

supplying a predetermined amount of the raw material in a hole of a die;

compacting the raw material into a cup-shaped green compact by pressing the raw material by a punch, the cup-shaped green compact having a cylindrical portion, a bottom formed at one end portion thereof, and an opening formed at another end portion thereof;

cooling the cup-shaped green compact so as to maintain the shape of the green compact by the hardened binder;

ejecting the cup-shaped green compact from the hole of the die;

removing the binder from the ejected cup-shaped green compact by heating; and sintering the cup-shaped green compact by heating the green compact, thereby diffusion-bonding the particles of the green compact, wherein the binder includes 40 to 80 volume % of the wax, and in the compacting, the raw material is heated to a temperature that is a softening point of the thermoplastic resin or higher, and in the ejecting, the green compact is cooled to a temperature that is the softening point of the thermoplastic resin or lower and that is a softening point of the wax or higher.

2. A production method for an electrode for a cold cathode fluorescent lamp according to claim 1, wherein the punch has a first punch, a second punch, and a third punch, the first punch used for forming the bottom of the cup-shaped green compact, the second punch used for forming an inner diameter portion of the cup-shaped green compact, the third punch used for pressing an edge surface of the opening, and the first punch is fixed to the die, the second punch is pressed toward the raw material, and a backpressure is applied to the raw material by the third punch, so that the compacting is performed.

3. A production method for an electrode for a cold cathode fluorescent lamp according to claim 1, the Mo powder or the W powder has a particle of 10 μm or less, the Mo powder has a tap density of 3.0 $Mg/m^3$ or more, and the W powder has a tap density of 5.6 $Mg/m^3$ or more.

4. A production method for an electrode for a cold cathode fluorescent lamp according to claim 1, wherein a predetermined amount of the raw powder, which corresponds to that required in the compacting process, is formed into a pellet after the heating and kneading, and the pellet is supplied in a hole of the die in the supplying process.

5. A production method for an electrode for a cold cathode fluorescent lamp according to claims 1, wherein the metal powder further includes 2.0 mass % or less of a Ni powder, and the sintering is performed in one of an inert gas atmosphere and a pressure reduction atmosphere which includes an inert gas as a carrier gas and has a pressure of 15 kPa or more.

6. A production method for an electrode for a cold cathode fluorescent lamp according to claim 1, wherein the metal powder further includes 0.5 to 4.0 mass % of a Ni powder, and the sintering is performed in a pressure reduction atmosphere which has a pressure of less than 15 kPa.

7. A production method for an electrode for a cold cathode fluorescent lamp according to claim 5, wherein the Ni powder has a particle size of 15 μm or less.

8. A production method for an electrode for a cold cathode fluorescent lamp according to claim 6, wherein the Ni powder has a particle size of 15 μm or less.

9. A production method for an electrode for a cold cathode fluorescent lamp according to claim 1, wherein the removing of the binder includes:

a first step in which the wax is sublimed, and a second step in which the thermoplastic resin is thermally decomposed.

10. A production method for an electrode for a cold cathode fluorescent lamp according to claim 9, wherein a constant temperature time of the first step is 30 to 180 min, and a constant temperature time of the second step is 30 to 180 min.

11. A production method for an electrode for a cold cathode fluorescent lamp according to claim 1, wherein the cold cathode fluorescent lamp after sintering includes 0.01 to 0.5 mass % of C.

12. A production method for an electrode for a cold cathode fluorescent lamp according to claim 5, wherein the cold cathode fluorescent lamp after sintering includes 0.01 to 0.15 mass % of C.

13. A production method for an electrode for a cold cathode fluorescent lamp according to claim 6, wherein the cold cathode fluorescent lamp after sintering includes 0.01 to 0.15 mass % of C.

14. A production method for an electrode for a cold cathode fluorescent lamp according to claim 1, wherein the cold cathode fluorescent lamp after sintering has a density ratio of 80 to 96%.

15. A production method for an electrode for a cold cathode fluorescent lamp according to claim 1, wherein the metal powder is composed of Mo, and the sintering is performed at the temperature of from 1500° C. to 2200° C.

16. A production method for an electrode for a cold cathode fluorescent lamp according to claim 1, wherein the metal powder is composed of W, and the sintering is performed at the temperature of from 1700° C. to 2400° C.

17. A production method for an electrode for a cold cathode fluorescent lamp according to claim 5, wherein the metal powder is composed of Mo, and the sintering is performed at the temperature of from 1400° C. to 2200° C.

18. A production method for an electrode for a cold cathode fluorescent lamp according to claim 6, wherein the metal powder is composed of Mo, and the sintering is performed at the temperature of from 1400° C. to 2200° C.

19. A production method for an electrode for a cold cathode fluorescent lamp according to claim 5, wherein the metal powder is composed of W, and the sintering is performed at the temperature of from 1500° C. to 2200° C.

20. A production method for an electrode for a cold cathode fluorescent lamp according to claim 6, wherein the metal powder is composed of W, and the sintering is performed at the temperature of from 1500° C. to 2200° C.

21. A production method for an electrode for a cold cathodoluminescent lamp according to claim 1, wherein the electrode has a thickness of 0.1 to 0.3 mm.

* * * * *